US010184755B2

(12) United States Patent
Moultrie et al.

(10) Patent No.: US 10,184,755 B2
(45) Date of Patent: Jan. 22, 2019

(54) HYBRID HOLSTER

(71) Applicant: SHTF GEAR LLC, Logan, UT (US)

(72) Inventors: Clay Thomas Moultrie, Hyrum, UT (US); Mark Anderson Lyman, Logan, UT (US)

(73) Assignee: SHTF GEAR LLC, Logan, UT (US)

( * ) Notice: Subject to any disclaimer, the term of this patent is extended or adjusted under 35 U.S.C. 154(b) by 109 days.

(21) Appl. No.: 15/333,453

(22) Filed: Oct. 25, 2016

(65) Prior Publication Data

US 2017/0115095 A1 Apr. 27, 2017

Related U.S. Application Data

(60) Provisional application No. 62/246,956, filed on Oct. 27, 2015.

(51) Int. Cl.
*F41C 33/04* (2006.01)
*F41C 33/02* (2006.01)

(52) U.S. Cl.
CPC ..... *F41C 33/041* (2013.01); *F41C 33/0209* (2013.01); *F41C 33/048* (2013.01)

(58) Field of Classification Search
CPC ..... F41C 33/048
USPC ..... 224/587, 912, 911, 194
See application file for complete search history.

(56) References Cited

U.S. PATENT DOCUMENTS 3,630,420 A * 12/1971 Bianchi ..... F41C 33/0209 224/193
3,977,583 A * 8/1976 Bianchi ..... F41C 33/0227 224/193
4,828,154 A * 5/1989 Clifton, Jr. ..... A45F 5/14 224/192
5,018,654 A * 5/1991 Rogers ..... F41C 33/0227 224/244
5,054,671 A * 10/1991 Else ..... F41C 33/0209 224/192
5,170,919 A * 12/1992 DeSantis ..... A45C 1/04 224/192
5,215,238 A * 6/1993 Baruch ..... F41A 17/54 224/243
5,265,781 A * 11/1993 Nichols ..... F41C 33/0227 224/197
5,282,559 A * 2/1994 Wisser ..... F41C 33/0227 224/193
5,544,794 A * 8/1996 Nichols ..... F41C 33/0245 224/198
6,050,465 A * 4/2000 Nelson ..... A45F 5/00 220/62.22
6,089,432 A * 7/2000 Gage ..... F41C 33/0227 224/191
6,854,626 B2 * 2/2005 Liao ..... F41C 33/0227 224/244

(Continued)

*Primary Examiner* — Brian D Nash

(74) *Attorney, Agent, or Firm* — Preston P. Frischknecht; Project CIP

(57) ABSTRACT

Embodiments of the present invention include a holster with a first holster layer of leather configured as a holster backer for wear adjacent to a user's body, the first holster layer attached to a second holster layer of Kydex, the second holster layer molded to fit over a portion of a handgun, the holster further having a trigger guard retention formed from the material of the second holster layer, the retention having an integral pocket that is capable of interference fit with a handgun.

23 Claims, 5 Drawing Sheets

(56) References Cited

U.S. PATENT DOCUMENTS

| | | | | |
|---|---|---|---|---|
| 7,258,259 | B1 * | 8/2007 | Owens | A45F 5/02 224/192 |
| 7,461,765 | B2 * | 12/2008 | French | F41C 33/0227 224/238 |
| 8,074,850 | B2 * | 12/2011 | Soderquist | F41C 33/0227 224/243 |
| 8,672,201 | B2 * | 3/2014 | Craighead | F41C 33/041 224/587 |
| 2009/0321480 | A1 * | 12/2009 | Kincaid | F41C 33/0227 224/243 |
| 2010/0181353 | A1 * | 7/2010 | Craighead | F41C 33/0236 224/193 |
| 2013/0181021 | A1 * | 7/2013 | Yarbrough | F41C 33/0236 224/244 |
| 2016/0102940 | A1 * | 4/2016 | Sykes | F41C 33/0236 224/587 |

* cited by examiner

HYBRID HOLSTER

RELATED APPLICATIONS

This application claims priority to a provisional application, filed on Oct. 27, 2015, U.S. App. No. 62/246,956.

BACKGROUND OF THE INVENTION

There are a wide variety of concealed carry methods for handgun users. One popular carry style involves holstering a handgun inside the waistband ("IWB"). Holster products used to facilitate IWB carry include the: (1) single clip hybrid holster and (2) full Kydex holster. To varying extent, and as explained further below, each of these holster products utilize Kydex. Kydex provides holster products a functional material that is waterproof, scratch resistant, shape retentive over time with respect to a predetermined three-dimensional form, and relatively low friction.

The abovementioned holster types are discussed in turn. First, traditional single clip hybrid holsters function, in part, by sandwiching a handgun between a first holster layer of leather (adjacent to a user's body) and a second holster layer of molded Kydex (distal from the user's body).

Importantly, one problem with single clip hybrid holsters is that, although the leather layer provides comfort and yield or dynamism as the main body contact surface for the user, this layer also tends to soften and/or lose shape over time. This softening reduces the overall handgun retention efficiency of the holster.

Second, full Kydex holsters provide an alternative to traditional single clip hybrid IWB holsters because they use Kydex (instead of leather) for the first holster layer. This more extensive use of Kydex ensures higher shape and firearm retention efficiency of the holster over time, but it also sacrifices the comfort and dynamism otherwise afforded by a leather layer.

Ultimately, despite the variation provided by single clip hybrid and full Kydex holsters, a problem remains with respect to optimally blending the form and function of leather and Kydex in IWB holsters.

SUMMARY OF THE INVENTION

In accordance with the above, a new and innovative, hybrid holster is provided alternatively known as a "three quarters hybrid holster." The problem of incorporating the comfort and dynamism of a leather layer together with the optimal retention properties of Kydex to achieve an IWB holster is solved. Embodiments of the present invention include a holster with a first holster layer of leather configured as a holster backer for wear adjacent to a user's body, the first holster layer attached to a second holster layer of Kydex, the second holster layer molded to fit over a portion of a handgun, the holster further having an integral trigger guard retention formed from the material of the second holster layer, the retention having a pocket that is capable of interference fit with a handgun.

These and other aspects of the present invention will become more fully apparent from the following description and appended claims, or may be learned by the practice of the invention as set forth hereinafter.

BRIEF DESCRIPTION OF THE FIGURES

To further clarify the above and other aspects of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The drawings may not be drawn to scale. The invention will be described and explained with additional specificity and detail through the use of the accompanying drawings in which.

DETAILED DESCRIPTION OF THE ILLUSTRATED EMBODIMENT

The present invention in its various embodiments, some of which are depicted in the figures herein, is a hybrid holster.

Figure 1:
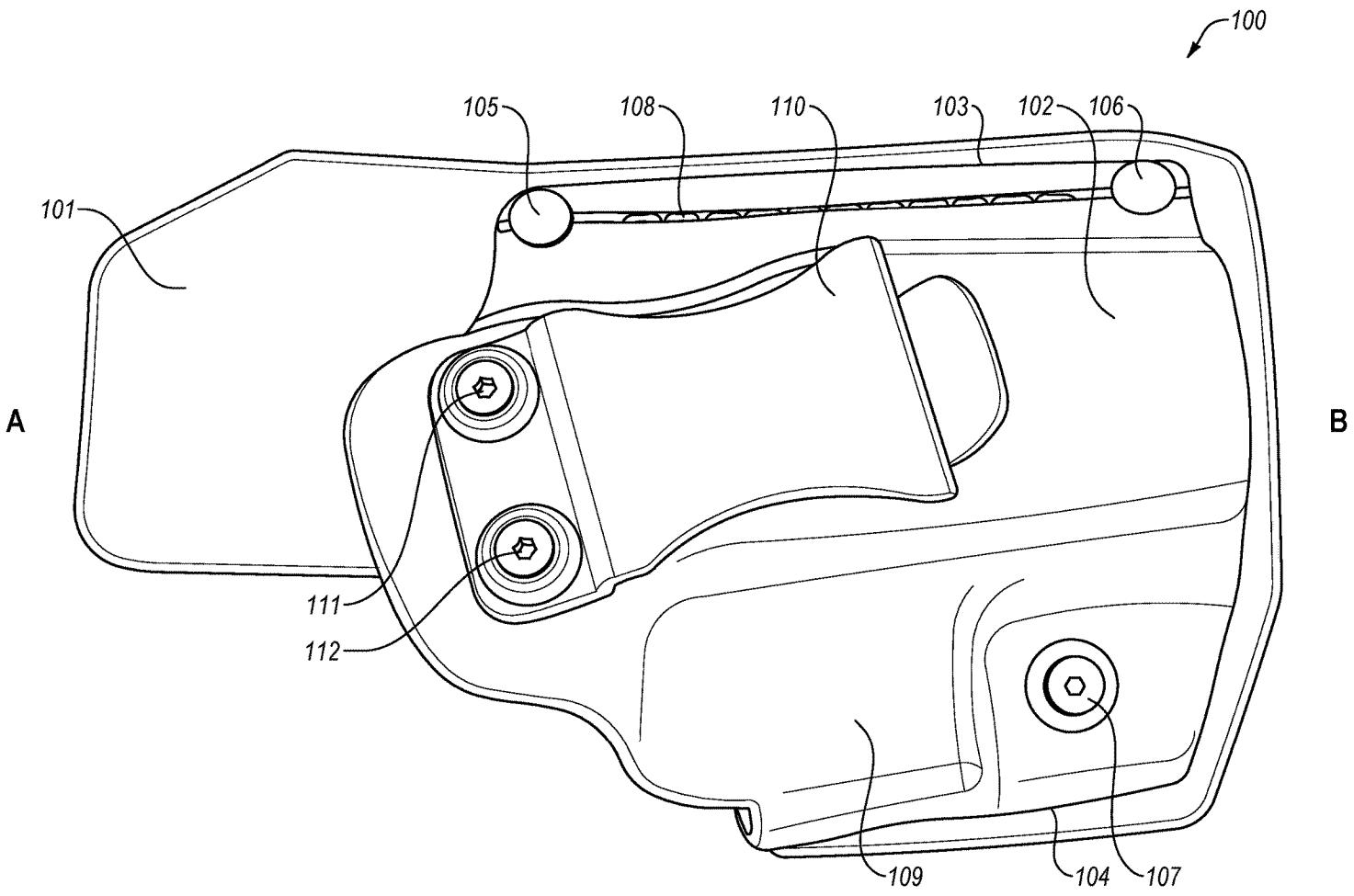
FIG. 1 is a top view of one embodiment of the holster.

Referring now to FIG. 1, the holster 100 is comprised of a first holster layer 101 of leather that is primarily configured to provide a comfortable and dynamic surface contacting a user's body and to provide a barrier and retention layer between the user's body and the handgun when the holster is in use. In many embodiments this first holster layer 101 is generally planar and/or conformable to a user's body.

The holster 100 is further comprised of a second holster layer 102 of Kydex that is molded to generally conform to, fit over, and retain a portion of a particular handgun model or models. This second holster layer 102 may have one or more edges 103, 104 adjacent to which the second holster layer 102 is attached to the first holster layer 101 via rivets 105, 106, 107 and/or stitching 108.

The holster 100 may also have additional features such as one or more over the belt clips 110 which function to secure the holster 100 to a user's belt and/or outer garment on the outside of the waistband. The holster 100 of the illustrated embodiment has a single clip 110 attached to the outside of the second holster layer 102 through two fasteners 111, 112. In other embodiments, clips may be configured to go under the belt.

Figure 4:
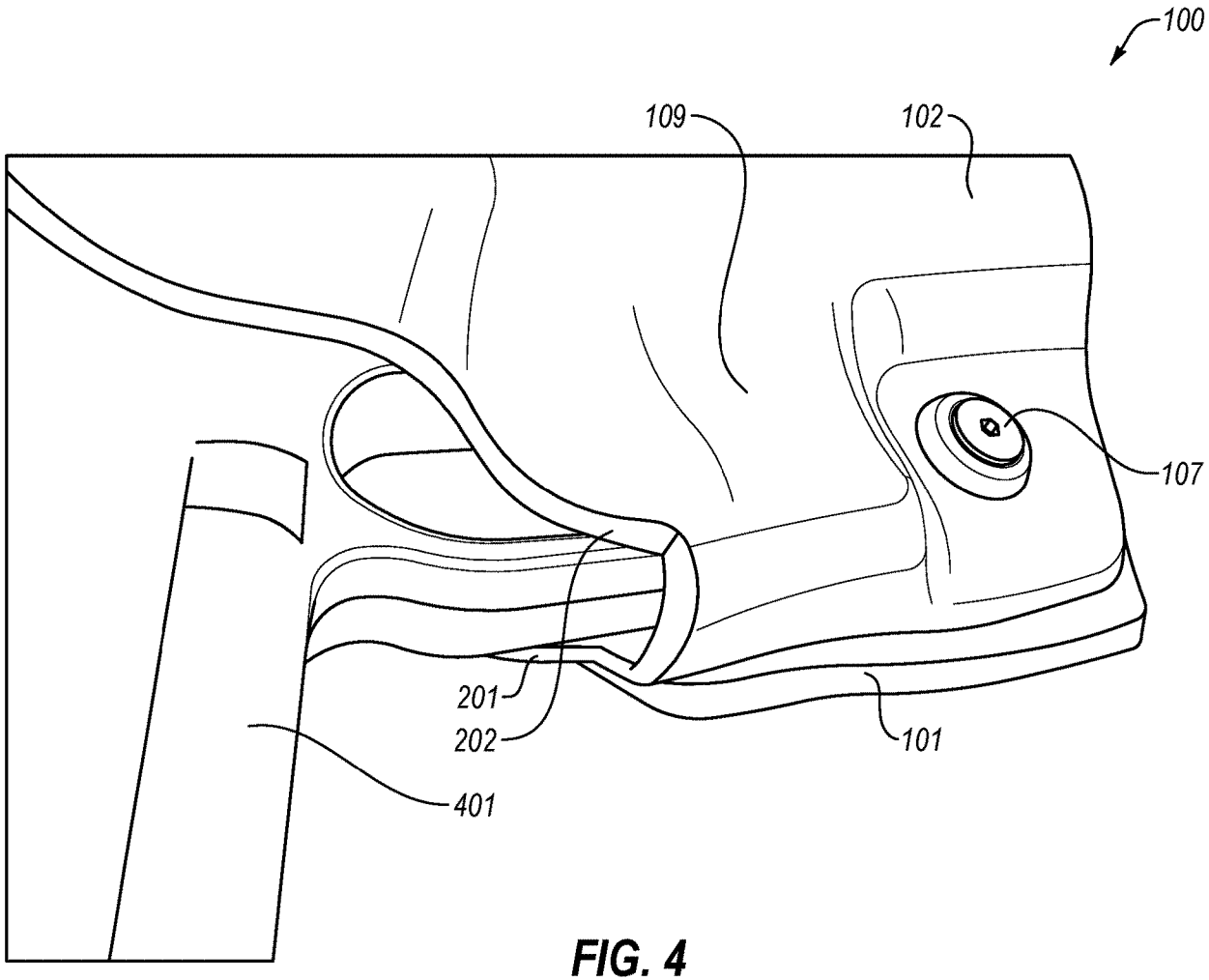
FIG. 4 is a close-up, perspective view of a trigger guard retention feature of one embodiment of the holster.

In operation, a handgun may be pushed by a user into end A of the holster 100 towards end B, and the handgun thereby releasably retained within the holster, principally through an interference fit achieved through a trigger guard retention 109. (See also FIG. 4).

Figure 2:
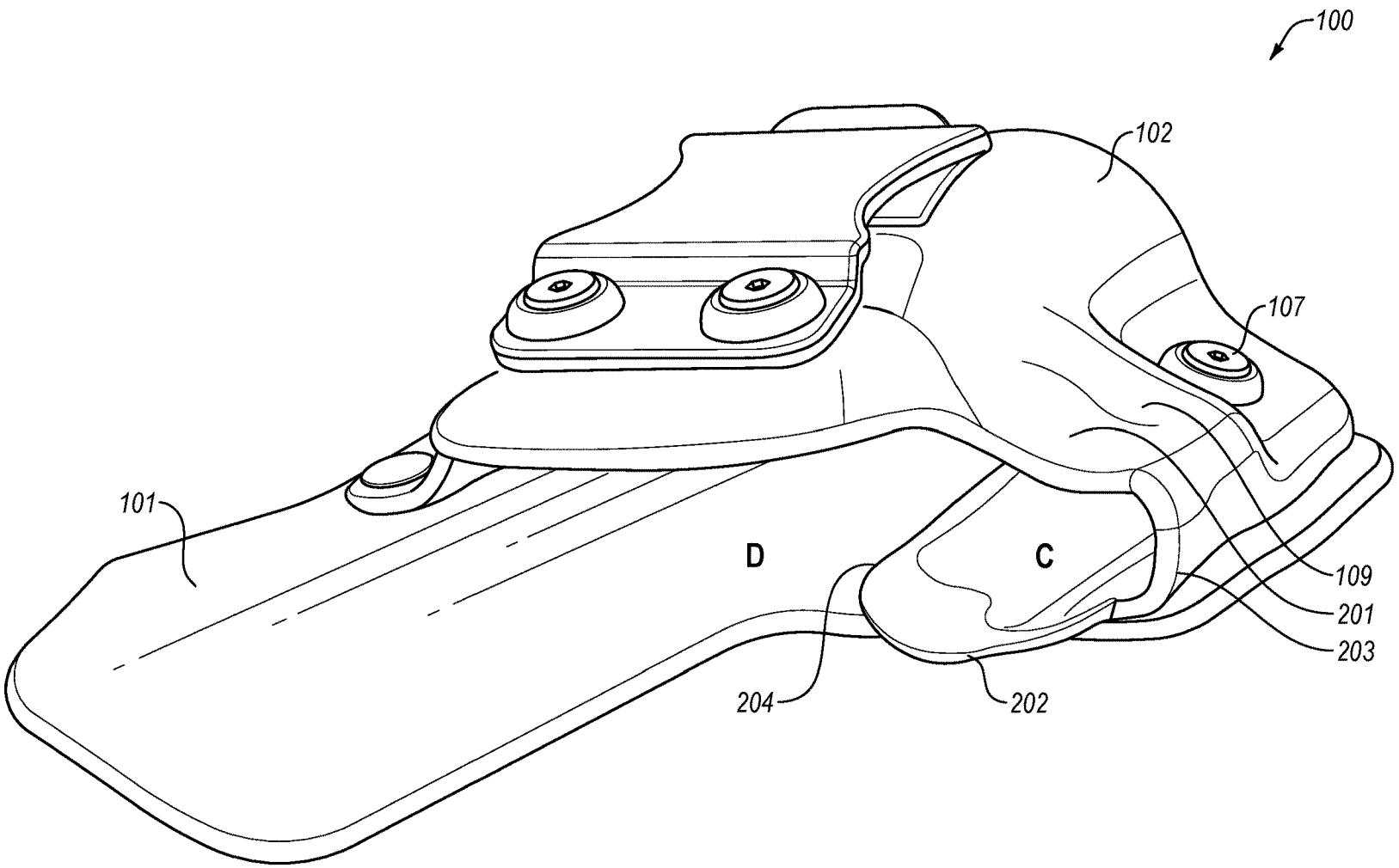
FIG. 2 is a perspective view of one embodiment of the holster.

Referring now to FIG. 2, further detail of the holster 100 and specifically, the trigger guard retention 109, is shown. In particular, an interior portion D of the holster 100 is formed between first 101 and second 102 holster layers. The trigger guard retention 109 is comprised of a substantially Kydex-bounded pocket C within interior D. In various embodiments, interior portion D is substantially larger in area than pocket C and generally bounded by leather from the first holster layer 101 which is located proximal to a user's body when the holster 100 in operation.

Figure 3:
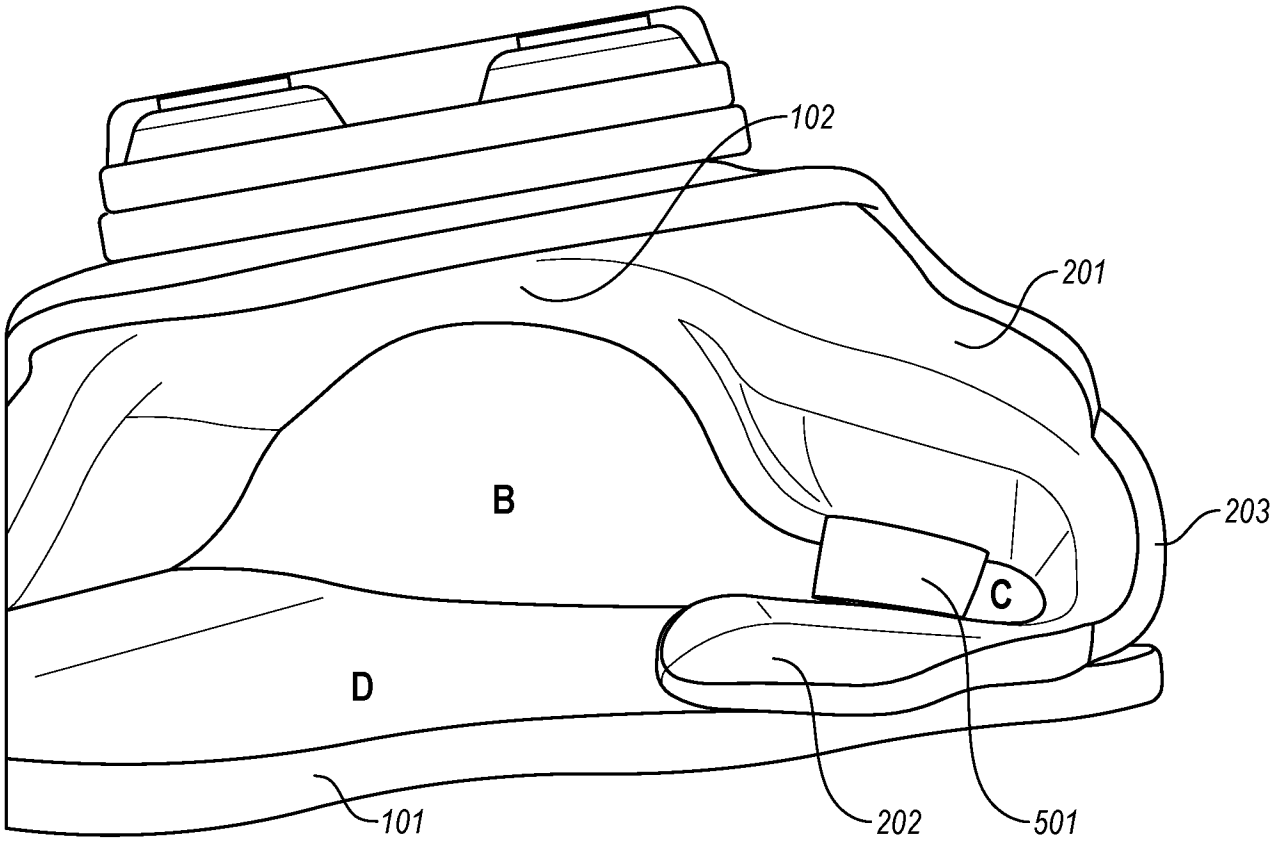
FIG. 3 is a close-up, perspective view of a trigger guard retention feature of one embodiment of the holster.
Figure 5:
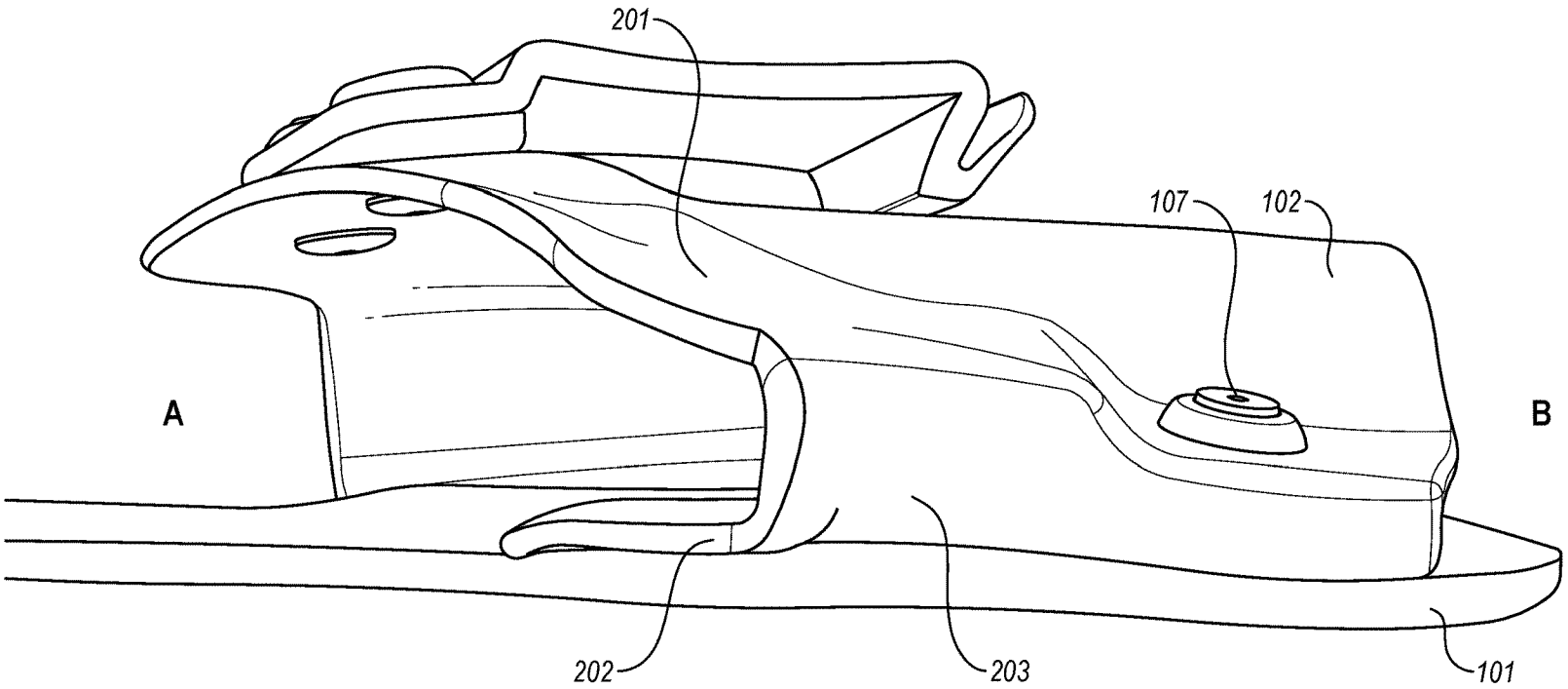
FIG. 5 is a side view of one embodiment of the holster.

In various embodiments, the substantially Kydex-bounded pocket C is formed from a portion of integral and/or seamless second holster layer 102 which is folded over to create a curved edge 203 (see also FIG. 5) and opposite first 201 and second 202 trigger guard retention sides configured to receive and retain the trigger guard of a handgun. In other embodiments, pocket C may not be integral and/or seamless, and may be comprised of two or more sections. The substantially Kydex-bounded pocket C may have one or more ends or edges 204 configured to terminate approximately adjacent to a point between the frame and trigger of a holstered handgun. Referring briefly to FIG. 3, some embodiments of the invention may use a spacer 501 between or adjacent to the first 201 and second 202 trigger guard retention sides in order to facilitate a predetermined width (that corresponds to a particular handgun's trigger guard width) and consequently, interference fit with a particular handgun model trigger guard within pocket C. In particular, in certain embodiments, the spacer is somewhat flexible and works in connection with a post and screw such that a user may adjust the screw to achieve corresponding retention adjustment. In preferred embodiments, the substantially Kydex-bounded pocket C is configured to directly contact the trigger guard of a holstered handgun.

By combining a Kydex trigger guard retention 109 with a first holster layer 101 of leather, the problem of optimizing the comfort and dynamism of leather and the retention efficiency of Kydex in an IWB holster is solved. In particular, a significant portion of body proximal side of the holster 100 is a dynamic leather layer 101 that provides user comfort and is structured to facilitate softening without adversely affecting retention. Synergistically, the main retention function of the holster 100 is performed by a Kydex bounded pocket C that retains a handgun trigger guard through an interference fit located adjacent to the leather comfort layer.

The present invention may be embodied in other specific forms without departing from its spirit or essential characteristics. For example, the Kydex trigger guard retention may be applied to over the waistband (OWB) holsters. Moreover, the system described above can also be used within a broader modular system wherein the Kydex portion of the holster is interchangeable between and/or removeably attachable to various backers, including, but not limited to, single-clip IWB, dual-clip IWB, and/or OWB.

Additionally, various materials may be used to achieve the purpose and scope of the invention. Merely by way of example, instead of leather, the first holster layer may be any other material with properties similar to leather, including but not limited to: EVA (Ethylene-vinyl acetate), XLPE (Cross-linked polyethylene), Neoprene and/or PE (Polyethylene) foams; Nylon or Polyester fabrics; TPO (Thermoplastic Polyolefin); TPU (Thermoplastic polyurethane); or PVC (Polyvinyl Chloride).

Additionally, instead of Kydex, the second holster layer may be any other thermoplastic with similar shape-retentive properties, including, but not limited to: ABS (Acrylonitrile Butadiene Styrene), PVC (Polyvinyl Chloride), PVC/Acrylic (Kydex, Boltaron), Nylon (Polyamide), PC (PolyCarbonate), Acrylic (PMMA—Polymethyl Methacrylate), HDPE (High Density Polyethylene), HIPS (High Impact Polystyrene), PIE (Polyetherimide), PETG (Polyethylene Terephthalate Glycol), PP (Polypropylene), and TPO (Thermoplastic Polyolefin).

The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A holster with a first holster layer made of one or more first materials, the first holster layer configured as a holster backer for wear adjacent to a user's body and attached to a second holster layer made of one or more second materials, the one or more second materials configured to impart to the second holster layer more shape retentiveness over time with respect to a predetermined three-dimensional form through non-leaf spring means than the one or more first materials of the first holster layer, the second holster layer molded to fit over a portion of a handgun, the holster further having a trigger guard retention formed from the material of the second holster layer, the second layer and the trigger guard retention having a pocket formed only from the one or more second materials and that is capable of interference fit with a handgun.

2. The holster of claim 1, wherein the first holster layer is substantially of one of the following: leather; EVA (Ethylene-vinyl acetate), XLPE (Cross-linked polyethylene), Neoprene and/or PE (Polyethylene) foams; Nylon or Polyester fabrics; TPO (Thermoplastic Polyolefin); TPU (Thermoplastic polyurethane); and PVC (Polyvinyl Chloride).

3. The holster of claim 1, wherein the second holster layer is substantially of one of the following: Kydex, ABS (Acrylonitrile Butadiene Styrene), PVC (Polyvinyl Chloride), PVC/Acrylic (Kydex, Boltaron), Nylon (Polyamide), PC (PolyCarbonate), Acrylic (PMMA—Polymethyl Methacrylate), HDPE (High Density Polyethylene), HIPS (High Impact Polystyrene), PIE (Polyetherimide), PETG (Polyethylene Terephthalate Glycol), PP (Polypropylene), and TPO (Thermoplastic Polyolefin).

4. The holster of claim 1, wherein compression of the interference fit is adjustable by a user.

5. The holster of claim 1, wherein a substantial portion of the first holster layer does not contact the second holster layer.

6. The holster of claim 1, the holster further configured for wear by a user inside the user's waistband.

7. The holster of claim 1, the holster further configured for wear by a user outside the user's waistband.

8. A holster with a first holster layer of leather configured as a holster backer for wear adjacent to a user's body, the first holster layer attached to a second holster layer of Kydex molded to fit over a portion of a handgun, the holster further having a trigger guard retention with a substantially Kydex-bounded pocket that is formed from a portion of the second holster layer, the substantially Kydex-bounded pocket having one or more ends configured to terminate adjacent to a point between the frame and trigger of a holstered handgun, the trigger guard retention capable of adjustable interference fit with the handgun.

9. The holster of claim 8, wherein a substantial portion of the first holster layer does not contact the second holster layer.

10. The holster of claim 8, further comprising a means for retaining the holster on a user's waistband.

11. The holster of claim 8, the interference fit further comprised of an external adjustor means by which a user may adjust the compression of the fit.

12. The holster of claim 8, the second holster layer further removably attachable to the first holster layer.

13. The holster of claim 8, the holster further configured for wear by a user inside the user's waistband.

14. The holster of claim 8, the holster further configured for wear by a user outside the user's waistband.

15. The holster of claim 8, wherein the substantially Kydex-bounded pocket is configured to directly contact the trigger guard of a holstered handgun.

16. A holster with a first holster layer of leather configured as a holster backer for wear adjacent to a user's body, the first holster layer attached to a second holster layer of Kydex molded to fit over a portion of a handgun, the holster further having a trigger guard retention with a substantially Kydex-bounded pocket that is formed from a portion of the second holster layer, the substantially Kydex-bounded pocket having one or more ends configured to terminate adjacent to a point between the frame and trigger of a holstered handgun, the trigger guard retention capable of adjustable interference fit with the handgun.

17. The holster of claim 16, wherein a substantial portion of the first holster layer does not contact the second holster layer.

18. The holster of claim 16, the holster further configured for wear by a user inside the user's waistband.

19. The holster of claim 16, the holster further configured for wear by a user outside the user's waistband.

20. A holster with a first integral thermoplastic holster layer molded to fit over a portion of a handgun, the first thermoplastic layer further having a trigger guard retention with a pocket that is formed only from a portion of the first thermoplastic layer and the retention further capable of an interference fit with a handgun, the pocket configured to substantially bound a trigger guard and leave a portion of a handgun exposed to a second holster layer generally configured of a material that is different than first integral thermoplastic holster layer and less shape retentive over time with respect to a predetermined three-dimensional form than the first holster layer.

21. The holster of claim 20, the interference fit further comprised of an external adjustor means by which a user may adjust the compression of the fit.

22. A holster with a first holster layer made of one or more first materials, the first holster layer configured as a holster backer for wear adjacent to a user's body and attached to a second holster layer made of one or more second materials, the one or more second materials more shape retentive over time with respect to a predetermined three-dimensional form than the one or more first materials of the first holster layer, the second holster layer molded to fit over a portion of a handgun, the holster further having a trigger guard retention formed from the second layer and having a first pocket that is capable of interference fit with a handgun, wherein first and second layers form a second pocket for retaining a firearm, the second pocket having a first side configured for placement against a user's body when in use, wherein the first side is substantially only one or more first materials.

23. The holster of claim 22, wherein the first pocket is seamless.

* * * * *